United States Patent [19]

McWain

[11] Patent Number: 4,905,992

[45] Date of Patent: Mar. 6, 1990

[54] COLLAPSIBLE WEIGHT SYSTEM

[76] Inventor: Richard J. McWain, 510 West Chapman, Orange, Calif. 92668

[21] Appl. No.: 286,279

[22] Filed: Dec. 19, 1988

Related U.S. Application Data

[63] Continuation-in-part of Ser. No. 202,328, Jun. 6, 1988, Pat. No. 4,854,576.

[51] Int. Cl.[4] ..... A63B 13/00

[52] U.S. Cl. ..... 272/123

[58] Field of Search ..... 272/67, 68, 116, 117, 272/119, 122, 123, 124, 130, 143; 383/120; 224/148

[56] References Cited

U.S. PATENT DOCUMENTS

| | | | |
|---|---|---|---|
| 325,987 | 9/1885 | Sparks | 272/124 |
| 2,780,378 | 2/1957 | Romano | 383/120 X |
| 3,231,270 | 1/1966 | Winer | 272/123 |
| 3,334,899 | 8/1967 | Bosko et al. | 272/123 |
| 3,781,007 | 12/1973 | Baker et al. | 272/123 |
| 4,029,312 | 6/1977 | Wright | 272/123 |
| 4,079,236 | 2/1978 | Ionel | 272/123 |
| 4,193,518 | 3/1980 | Holmes | 224/148 X |
| 4,199,140 | 4/1980 | Ferretti | 272/123 |
| 4,695,051 | 9/1987 | Tenison | 272/117 X |

FOREIGN PATENT DOCUMENTS

| | | | |
|---|---|---|---|
| 28047 | of 1912 | United Kingdom | 272/122 |

*Primary Examiner*—Richard J. Apley
*Assistant Examiner*—Robert W. Bahr

[57] ABSTRACT

A collapsible weight system provides a collapsible/expandable diaphragm for containing a liquid which includes a closed hub disclosed on one end thereof and an open hub disposed on another end thereof. A tubular cap is provided to seal the collapsible/expandable diaphragm while engaging both the closed hub and the open hub to provide axial support of the diaphragm. A pin locking system is provided in order to lock the tubular cap to a bar for lifting the weights. When the bar is engaged and locked with the cap, it extends therethrough providing additional strength and support for the collapsible/expandable diaphragm.

12 Claims, 3 Drawing Sheets

COLLAPSIBLE WEIGHT SYSTEM

This application is a continuation-in-part of U.S. patent Application Ser. No. 202,238, filed June 6, 1988, now U.S. Pat. No. 4,854,576.

The present invention relates to exercise equipment and more particularly relates to a collapsible weight system utilizing fewer elements which results in convenient portability and storage for the entire system.

Exercising through the use of weights has become increasingly popular as modern health-conscious attitudes among the general population continue to grow. While gymnasiums and exercise/health club facilities offering exotic arrays of exercise equipment, specifically designed for the toning of certain muscles in the body, continue to grow in popularity, weight lifting devices, such as barbells and dumbbells, are probably the most widely used of all the exercise equipment.

One reason for the popularity of the exercise/health clubs is the fact that most people do not enjoy adequate living space to provide for exercise equipment in their own home. Even though a large number of people own weight systems, most such systems are, by nature, heavy, bulky and awkward to store when not in use.

It should be recognized that a typical barbell or dumbbell system does not include just a pair of weights with a bar for lifting them, but rather a complete set of weights in order that the user may vary the exercise weight to his preference, or in accordance to his exercise regime.

Accordingly, modern weight lifting devices must be adapted for use by persons having various exercise goals as well as body condition, weight, and size. In addition, as hereinabove mentioned, an individual is expected to constantly vary the weight of his or her exercise equipment by the interchange of typically solid iron or metal filled plastic weights. Consequently, a variety of weight sizes must be kept in a ready stand-by area for use by the weight lifter.

To solve this problem, a number of designers have developed collapsible weight systems. One such system is disclosed in U.S. Pat. No. 3,231,207 to Winer, which discloses a barbell having collapsible chambers in order that the weight of the barbell system may be continuously varied by varying the amount of water disposed in each of the water chambers.

In this system the chambers are disposed on a bar and filled with water to a preselected amount. The capacity of each of the chambers is regulated by sealing the chamber to the bar at various positions therealong, thus expanding or contracting the water chamber to limit the space available for water. While this system is in fact collapsible and made lighter for shipment by removal of water from the water chambers, it is in fact not without severe limitations. First, because a seal must be established between the water chamber and the bar, adjustment of the water chamber by its movement along the bar gives rise to the possibility of water leakage around the seal. Further, to adjust the water content of any one water chamber, the entire barbell, with both water chambers, must be placed in a position for draining each one of the chambers without spilling thereof. This can become rather inconvenient for apartment dwellers who do not have access to open areas suitable for draining the chambers.

Further, many exercise regimes require the initial exercise to begin with a lighter weight and progressively increase of the weight lifted. It is obvious that such a regime is difficult to effectively carry out with the winner barbell system. For example, after a short period of time, a warmup with a lighter weight exercise must be stopped and the collapsible chambers opened, each of them adjusted on the bar and thereafter filled with water before exercise can resume utilizing a slightly heavier weight.

While it appears desirable to provide a collapsible weight system for the convenience of many exercise advocates, it is also most desirable to provide such a system which also does not disrupt the exercise regimes currently formulated and utilized by most people in such programs. In other words, a most desirable collapsible weight system would provide a number of refillable weights which can thereafter be utilized in a manner consistent with conventional exercise techniques. The present invention fills that need.

SUMMARY OF THE INVENTION

A collapsible weight system, in accordance with the present invention, generally includes collapsible diaphragm means for containing a liquid, a closed hub disposed on one end of the collapsible diaphragm means and open hub means for enabling filling of the collapsible diaphragm with a liquid and cap means sized for passing through the open hub means and engaging the closed hub for both sealing the open hub means and for providing a rigid axial support to the collapsible diaphragm means. To facilitate the cap, the open hub means is disposed on an opposite end of the collapsible diaphragm means and in a coaxial relationship with the closed hub.

Because the cap means provides rigid axial support for the collapsible diaphragm means, it is a self-contained unit when the cap means is in a sealing relationship therewith. This is particularly true when the collapsible diaphragm means is filled with water.

More particularly, the collapsible diaphragm means is collapsible along a longitudinal access thereof and the collapsible diaphragm means closed hub and open hub means are molded together, preferably from a single piece of material.

Importantly, the cap means, in accordance with the present invention, is further operative for controlling the expansion of the collapsible diaphragm in order to control the filled weight of the collapsible diaphragm. In this manner, the cap means may include a plurality of individual caps, each having a different length, with each length defining a different amount of expansion of the collapsible diaphragm when inserted through the open hub means sealed thereto and engaging the closed hub. Hence, when each diaphragm is filled utilizing a hub of a different length, a selection of fixed weight is available for the user in the same manner that the user would select a fixed iron or metal filled plastic weight.

More specifically, the collapsible weight system, in accordance with the present invention, may include bar means for engaging the cap means in order to enable lifting of the collapsible diaphragm in a manner consistent with conventional weight lifting exercises.

The cap means may comprise a tubular body having an open end thereon to enable the bar to be inserted therein along substantially the entire length thereof. In this manner, the bar provides additional rigidity to the cap means in its axial support of the collapsible diaphragm.

Means are provided for temporary locking the bar means to the cap means in order that the separation of the collapsible weight does not occur during exercise.

An alternative embodiment of a collapsible weight system, in accordance with the present invention, generally includes collapsible diaphragm means for containing a liquid, a first open hub disposed on one end of the collapsible diaphragm means and a second open hub disposed on an opposite end of the collapsible diaphragm means in a coaxial relationship with the first hub and cap means sized for passing through the second open hub and engaging the first hub for both sealing the first and second hubs and for providing a rigid axial support to the collapsible diaphragm means. The cap means includes a tubular body for enabling a bar to be inserted therethrough. This is important because it enables multiple collapsible diaphragms to be mounted on a bar in a side by side relationship.

BRIEF DESCRIPTION OF THE DRAWINGS

The advantages and features of the present invention will appear from the following description when considered in conjunction with the accompanying drawings in which.

DETAILED DESCRIPTION

Figure 1:
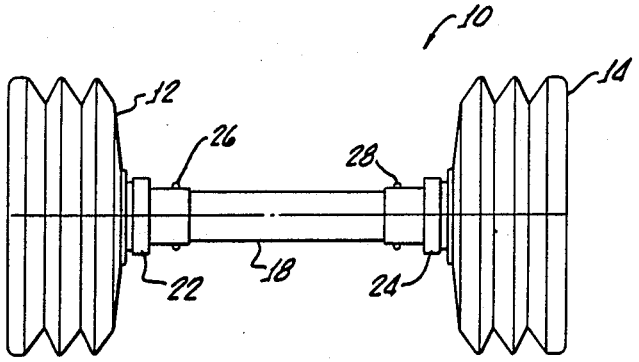
FIG. 1 is a front view of a collapsible weight system, in accordance with the present invention, generally showing a pair of collapsible diaphragms interconnected by a bar.

Turning now to FIG. 1, there is shown a collapsible weight system 10, in accordance with the present invention, generally showing collapsible diaphragms 12, 14, disposed on a bar 18 and locked thereto by means of caps 22, 24. Locking pins 26, 28, respectively, lock the caps 22, 24 to the bar 18, as will be hereinafter described in greater detail.

Hereinafter, a description will be directed to one collapsible diaphragm 12, it being understood that a plurality of identical collapsible diaphragms may be provided in accordance with the present invention, each having identical configuration.

In general, the collapsible diaphragm 12 may be molded from any suitable material, such as plastic, and of sufficient flexibility to enable an accordion-like structure 32, well known in the art, which is collapsible along a longitudinal axis 34 of the collapsible diaphragm means.

A closed hub 40 is disposed and preferably molded as part of the collapsible diaphragm on one end 42 thereof.

Disposed on an opposite end 44 of the collapsible diaphragm 12 and preferably molded thereinto is an open hub 46 which provides means for enabling the filling of the collapsible diaphragm 12 with a liquid, preferably water. It should be appreciated that the relatively wide opening 50 of the hub 46, as shown, approximately 20 percent of the diameter(d) of the collapsible diaphragm 12, facilitates the filling of the diaphragm 12 and further enables in-going water to easily expand the accordion-like structure 32 when the end 42 is held in a generally horizontal position for filling through the open hub 46 by means of a tap, or the like, (not shown).

This is to be distinguished from any prior art systems in which the filling of the collapsible weight is awkward because it does not allow axial filling of the collapsible weight with the accumulating weight of water therein causing continuous expansion of an accordion-like structure 32, as in the present invention.

Figure 2:
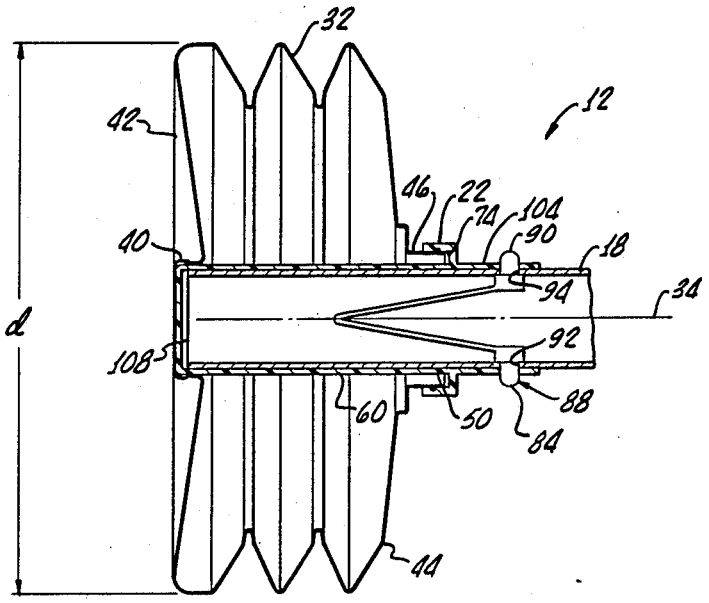
FIG. 2 is a cross-sectional view of one of the collapsible diaphragm shown in a locked position on the bar.
Figure 3:
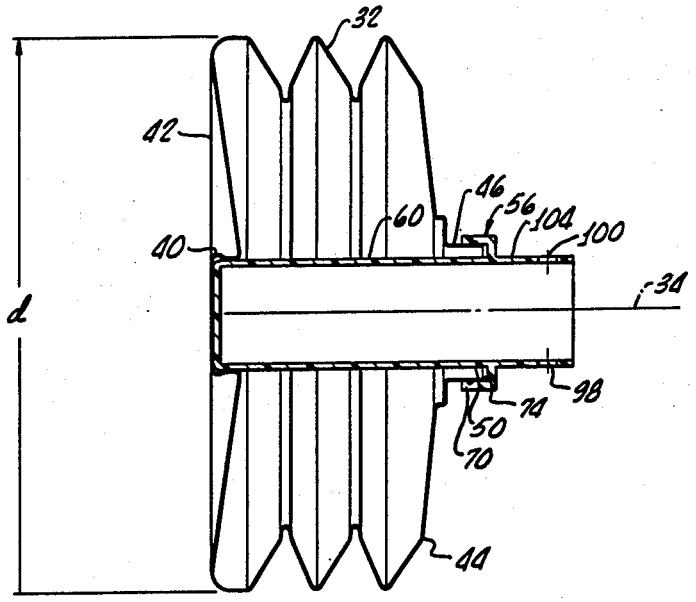
FIG. 3 is a cross-sectional side view similar to FIG. 2 showing a filled collapsible diaphragm sealed with a cap and ready for coupling to the bar.
Figure 4:
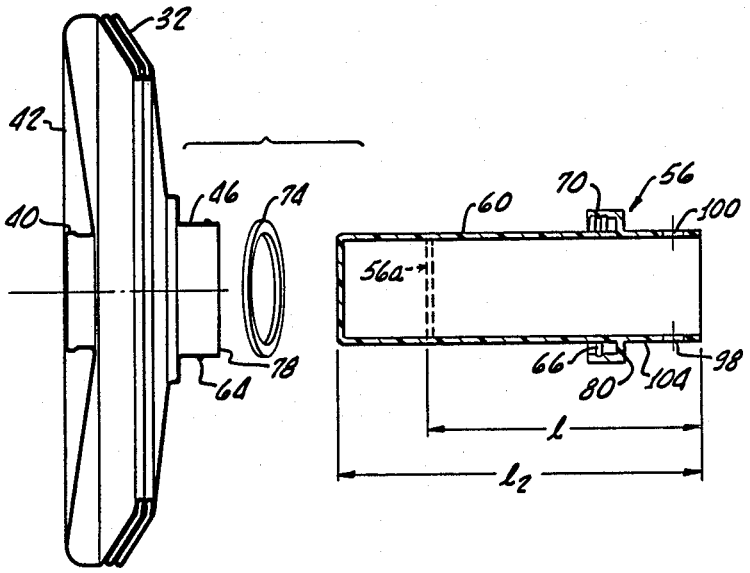
FIG. 4 is an exploded view of a collapsed diaphragm and cap, with a variation of cap length being shown in phantom line.

A tubular cap 56, which may be molded from any suitable material, such as plastic, and sized for passing through the open hub 46 is provided for both sealing the open hub 46 and for providing a rigid axial support to the collapsible diaphragm 12, the support being provided by a tubular body portion 60 of the cap which extends through the open hub 46 and engages the closed hub 40 (see FIGS. 2, 3 and 4). The cap 56 may be secured to the open hub 46 by means of quick screw threads 64 molded into the open hub and matching grooves 66 molded into an outwardly extending berm 70 on the cap 56. An annular seal 74 may be provided to ensure water-tight sealing of the diaphragm 12 via the cap 56. Alternatively, if the cap 56 is molded from a material of sufficient resiliency, pressure created between a lip 78 of the open hub 46 against a bottom 80 of the berm 70 may provide sufficient sealing.

It should be appreciated that the tubular body 60 of the cap 56 enables the cap to be further operative for controlling the expansion of the collapsible diaphragm 12 in order to control the filled weight of the collapsible diaphragm. That is, a cap 56*a* having a different length, (1) shown in phantom line in FIG. 4, will support a filled diaphragm 12 having less weight than the cap 56, shown in solid line in FIG. 4, having a length$(l)_2$.

Accordingly, the present invention includes a plurality of caps having different lengths, with each length defining a different amount of expansion of the collapsible diaphragm when inserted through the open hub 46 sealed thereto and engaging the closed hub 40.

As hereinbefore discussed, the cap 56 coupled to the diaphragm 12 provides a "stand alone" weight which may be used interchangeably with other identical, but filled with more or less water, diaphragms, so they may be employed with the bar in a conventional manner. In order to temporarily lock the cap 56 and diaphragm 12 to the bar 18, a molded pin clip 84 may be provided having opposing pins 88 and 90 extending through holes 92, 94, and corresponding holes 98, 100 in a shank portion 104 of the cap.

FIG. 2 shows the pin clip 84 securely locking the cap 56 and diaphragm 12 to the bar 18. To release the cap 56 and diaphragm 12, the pins 88, 90 may be depressed by thumb and finger pressure so that they clear the holes in the cap shank 104, thereby enabling removal of the cap 56 and diaphragm 12 from the bar 18.

It is important to note that in caps having different lengths will naturally require a set of holes (not shown), appropriately spaced from an end 108 of the bar 18 so that when the cap and diaphragm are locked to the bar 18, the bar end 108 engages the closed hub 40, thereby enabling the bar 18 to substantially increase the axial rigidity of the filled diaphragm 12.

Figure 5:
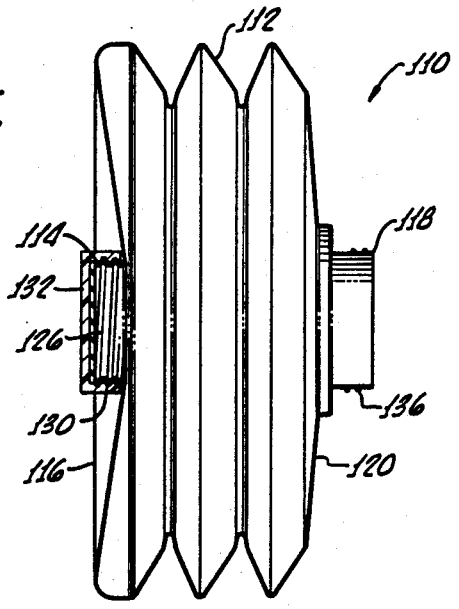
FIG. 5 is a side view, in cross section, of an alternative embodiment of a collapsible diaphragm showing a first and second open hub with a filling cup in place on a first of said open hubs.
Figure 6:
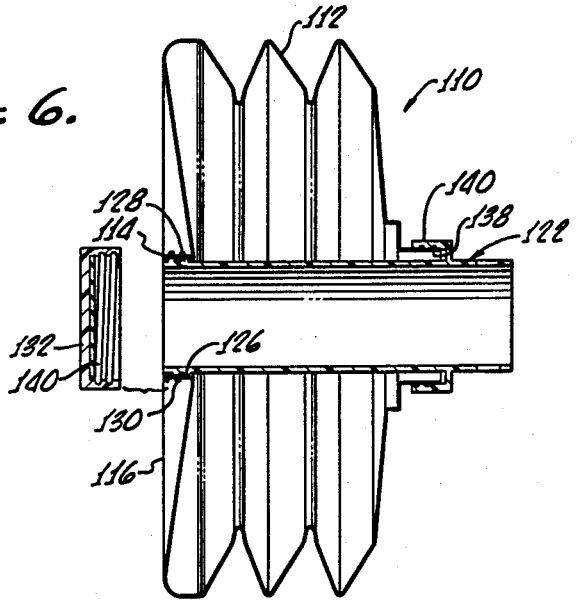
FIG. 6 is a side view of the collapsible diaphragm as shown in FIG. 5 with a tubular cup inserted through the collapsible diaphragm and engaging the first and second hubs.

Turning now to FIG. 5 there is shown an alternative embodiment 110 of the present invention, generally including a collapsible diaphragm 112 similar to the hereinbefore described collapsible diaphragm 12 having a first open hub 114 disposed on one end 116 of the collapsible diaphragm 112 and a second open hub 118 disposed on an opposite end 120 of the collapsible diaphragm 112. As can be seen from FIG. 5, the first and second open hubs 114, 118 are disposed in a coaxial relationship with one another for enabling a tubular cap 122, see FIG. 6, to be inserted therethrough. More particularly, the first open hub 114 includes interior threads 126, preferably molded thereinto for engaging mating threads 128 and the cap 122 and exterior threads 130 for engaging a filling cap 132. As previously described in connection with the first embodiment 10 of the present invention, the hub 118 is provided with threads 136 for mating threads 138 disposed on an extending berm 140 of the cap 122. The filling cap 132 includes threads 140 for enabling the filling cap to be secured and sealed to the first open hub 114 as shown in FIG. 5, to enable filling of the diaphragm through the second open hub 118.

Figure 7:
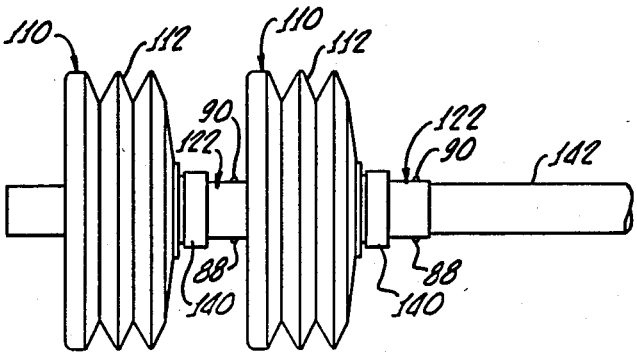
FIG. 7 is a side view of the collapsible diaphragm as shown in FIG. 6 installed on a bar while passing through the tubular cup.

After filling of the diaphragm 112, the cap 122 is inserted through the first and second hubs 114, 118, and screwed thereinto to provide a sealing engagement therewith. Thereafter, the filling cap 132 may be removed, thus enabling a bar 142 to be inserted through the tubular cap 122 as shown in FIG. 7, which enables the mounting of the collapsible diaphragm in a side-by-side relationship along the bar 142. It is also evident that the collapsible diaphragm 112 may be used in combination with the collapsible diaphragm 14, with the collapsible diaphragm 14 being installed on the end of the bar 142 (not shown) with the collapsible diaphragm 112 disposed adjacent thereto on the bar 142.

In this manner, the total weight of the system may be changed by varying the weight of each collapsible diaphragm with various amounts of water as hereinbefore described and also by adding additional collapsible diaphragms 112 to the same bar 142.

As hereinbefore discussed in connection with the collapsible diaphragm 14 and the cap 56, a molded pin clip 84, see FIG. 2, may be provided having opposing pins 88 and 90 for securing the diaphragm 112 to the bar 142.

Although there has been described hereinabove a specific collapsible weight system, in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. A collapsible weight system comprising:
collapsible diaphragm means for containing a liquid;
a first open hub disposed on an end of said collapsible diaphragm means;
a second open hub disposed on an opposite end of the collapsible diaphragm means in a coaxial relationship with said first hub; and
cap means, sized for passing through said second hub and engaging said first hub, for sealing said first and second hubs and for providing a rigid axial support to said collapsible diaphragm means, said cap means comprising a tubular body for enabling a bar to be inserted therethrough, said tubular body having a length proximately equal to the distance between the first and second open hubs.

2. The collapsible weight system according to claim 1 wherein said collapsible diaphragm means is collapsible along a longitudinal axis thereof.

3. The collapsible weight system according to claim 2 wherein said collapsible diaphragm means, first hub and second hub are molded together.

4. The collapsible weight system according to claim 1 wherein said cap means is further operative for controlling the expansion of the collapsible diaphragm in order to control the filled weight of the collapsible diaphragm, said cap means comprising a plurality of caps having different lengths, each length defining a different amount of expansion of the collapsible diaphragm when inserted through the second hub, sealed thereto and engaging and sealing said first hub.

5. A collapsible weight system comprising:
collapsible diaphragm means for containing a liquid;
a first hub disposed on one end of said collapsible diaphragm means;
second hub, said second hub means being disposed on an opposite end of the collapsible diaphragm means and in a coaxial relationship with said first hub;
cap means, sized for passing through said second hub and engaging said closed hub, for both sealing said first and second hub and for providing a rigid axial support to said collapsible diaphragm means, said cap means comprising a tubular body open on one end thereof to enable a bar to be inserted therethrough;
bar means sized for insertion into said cap means, for providing additional rigidity to the cap means and to enable lifting of said collapsible diaphragm in a manner consistent with conventional weight lifting exercises, and
means for temporarily locking said bar means to said cap means.

6. The collapsible weight system according to claim 5 wherein said collapsible diaphragm means is collapsible along a longitudinal axis thereof.

7. The collapsible weight system according to claim 6 wherein said collapsible diaphragm means, first hub, and second hub are molded together.

8. The collapsible weight system according to claim 7 wherein the means for temporarily locking said bar means to said cap means comprises a retractable pin disposed in said bar and sized for engaging openings in said cap means.

9. A collapsible weight system comprising:
collapsible diaphragm means for containing a liquid;
a first hub disposed on one side of said collapsible diaphragm means;
a second hub disposed on an opposite end of the collapsible diaphragm means and in a coaxial relationship with said first hub;
cap means for sealing said first and second hubs and for controlling the expansion of the collapsible diaphragm in order to control the filled weight of the collapsible diaphragm, said cap means comprising a plurality of caps having different lengths and each sized for passing through said second hub and engaging said firs hub;

bar means for engaging a cap in order to enable lifting of said collapsible diaphragm in a manner consistent with conventional weight lifting exercise; and means for temporarily locking said bar means to a cap sealing the first and second hubs.

10. The collapsible weight system according to claim 9 wherein said collapsible diaphragm means comprises a plurality of collapsible diaphragms, each sealable by one of the caps and interchangeable on said bar means when filled with water and sealed by a cap.

11. The collapsible weight system according to claim 10 where each collapsible diaphragm is collapsible along a longitudinal axis thereof.

12. The collapsible weight system according to claim 11 where each collapsible diaphragm has a first hub and a second hub molded thereinto.

* * * * *